United States Patent [19]

Wlodarski

[11] Patent Number: 4,516,445

[45] Date of Patent: May 14, 1985

[54] POWER-DRIVEN SCREWING TOOL FOR PRESSURE VESSEL HEADS

[76] Inventor: Antoine Wlodarski, 6500 Léon Derome St., Montreal, Canada, H1M 1S4

[21] Appl. No.: 511,228

[22] Filed: Jul. 6, 1983

[51] Int. Cl.[3] ..... B25B 13/00

[52] U.S. Cl. ..... 81/57.36

[58] Field of Search ..... 81/57.36

[56] References Cited

U.S. PATENT DOCUMENTS 1,785,125 12/1930 Kalo ..... 81/57.36

4,387,611 6/1983 Junkers ..... 81/57.36

*Primary Examiner*—Frederick R. Schmidt

*Assistant Examiner*—J. T. Zatarga

[57] ABSTRACT

The heads of a pressure vessel are normally attached to the vessel body by studs and nuts arranged in a bolting circle. Each nut is engaged by a wrench, the handle of which is radially outwardly disposed relative to the bolting circle. The outer ends of all the wrench handles have elongated openings slidably engaged by pivot pins that pivotally connect the handles to the ends of turnbuckles, so that the wrenches may all work concurrently. Preferably, the wrenches are ratchet-type socket wrenches. Hydraulic cylinders are attached to some of the wrench handles and impart a back-and-forth movement to the latter for screwing the nuts at a precisely-measured and uniform torque and all simultaneously. The arrangement can be modified to suit different numbers of studs and/or diameters of the bolting circle.

11 Claims, 7 Drawing Figures

FIG. 5
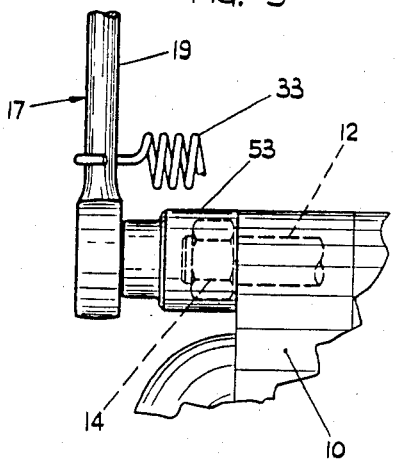
FIG. 6
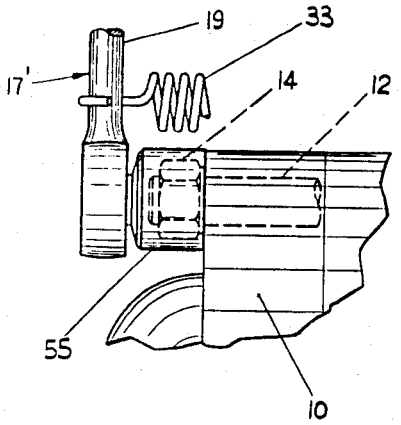
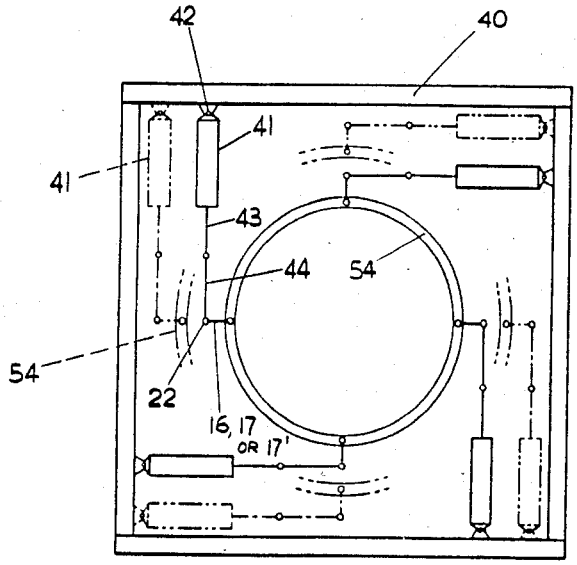
FIG. 7

POWER-DRIVEN SCREWING TOOL FOR PRESSURE VESSEL HEADS

FIELD OF THE INVENTION

This invention relates to a screwing tool for pressure vessel head bolting.

BACKGROUND OF THE INVENTION

Pressure vessel heads are fastened to the vessel body with an intermediate gasket by studs and nuts arranged in a bolting circle. It is essential that each nut be screwed with precisely the same torque to ensure a perfectly-tight closing of the head.

In the past, it was very difficult and time-consuming to obtain a leak-proof joint, even though a torque-metering wrench was used for screwing the nuts, because the latter were screwed one after the other, resulting in unequal flattening of the gasket around the head. This problem frequently occurs in nuclear pressure vessels, such as heat exchangers, wherein the gasket is metallic and must be replaced when unevenly flattened.

OBJECTS OF THE INVENTION

It is accordingly the main object of the present invention to provide a screwing tool of the character described, in which all the nuts of a pressure vessel head can be screwed simultaneously.

It is another object of the invention to provide a tool of the character described, in which all the nuts can be screwed with a precisely-matched torque.

Another object of the present invention is to provide a tool of the character described, which can be easily modified to suit the number of nuts and/or the diameter of the bolting circle.

SUMMARY OF THE INVENTION

Each pressure vessel head-fastening nut is engaged by a corresponding radially-extending wrench. All the wrenches are pivotally tied together at the outer ends of their handles along a tying circle concentric with the bolting circle formed by the nuts. Therefore, all the wrenches may rotate concurrently about the respective nut axis. Hydraulically-powered means cause simultaneous rotation of all the wrenches to screw or unscrew the nuts. Preferably, all the wrenches are maintained in a common plane by means of a support ring pivotally attached to their handles. Preferably also, spring means are assocated with each wrench to bias the latter into engagement with the nut. The parts of the whole arrangement are preferably detachable, so that the number of wrenches used can be varied together with their radial arrangement, so as to suit various numbers of bolts and nuts and/or various diameters of the bolting circle. The wrenches used are preferably ratchet-type socket wrenches.

BRIEF DESCRIPTION OF THE DRAWINGS

FIG. 5 and FIG. 6 are partial views similar to that of FIG. 2 but showing different types of socket wrenches; and FIG. 7 is a schematic elevation, as in FIG. 1, and showing how the tool can be used for bolting circles of various diameters.

DETAILED DESCRIPTION OF THE INVENTION

Figure 1:
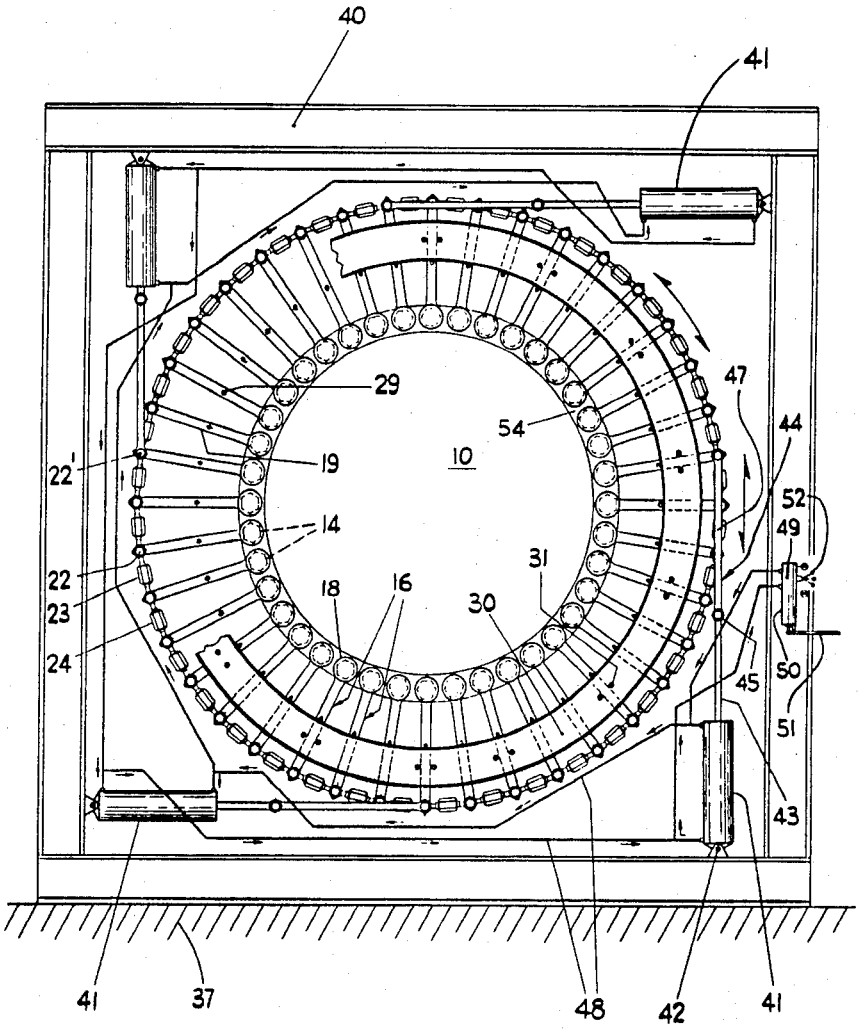
FIG. 1 is an end elevation of a pressure vessel with the screwing tool of the invention in operative position.
Figures 2, 3:
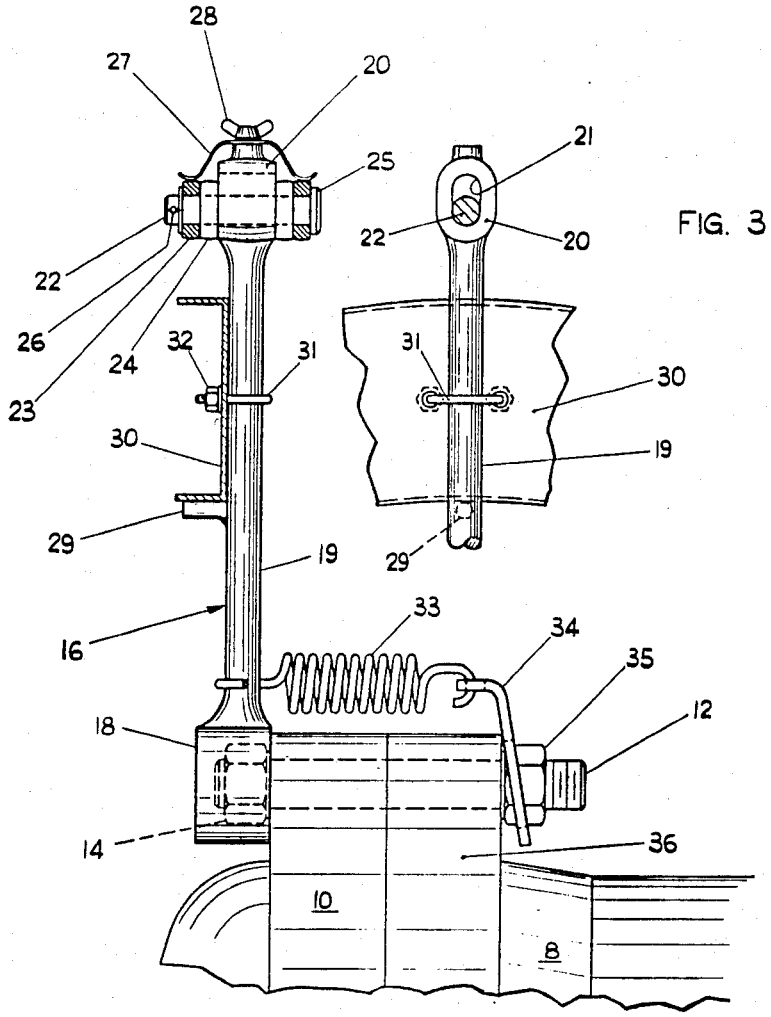
FIG. 2 is a side elevation of the end portion of the pressure vessel, on an enlarged scale, and showing the screwing arrangement partly in section.
FIG. 3 is a partial plan view of the support ring and one of the wrench handles attached thereto.

FIGS. 1 and 2 show a pressure vessel body 8, to the end of which is secured the head 10 by means of studs 12 and nuts 14. The nuts 14 and studs 12 are arranged along a bolting circle and are equally spaced apart along said circle.

In accordance with the invention, a plurality of wrenches are provided, that is as many wrenches as there are nuts 14 to be screwed or unscrewed. The wrenches are all similar and of the same construction. Each wrench may be a conventional ratchet-type box socket wrench, as shown at 16 in FIG. 2, or other conventional ratchet-type wrenches, as shown at 17 and 17' in FIGS. 5 and 6.

Referring to FIG. 2, the socket carried by the collar 18 at inner end of the straight handle 19 of the wrench is adapted to non-rotatably fit over the nut 14, with the handle 19 extending radially and outwardly of the bolting circle. According to the invention, the outer end of each handle 19 is formed with an enlarged boss 20, having an elongated opening 21 extending along the axis of the handle.

A transverse pivot pin 22 extends through opening 21 for each wrench. Each pin 22 retains the outer annular ends of the stems of two pairs of turn-buckles 23 and 24. The turn-buckles 23 of one pair are arranged externally of the turn-buckles 24 of the other pair. Each pair of turn-buckles extend between and pivotally interconnects the outer ends of the handles 19 of two adjacent socket wrenches 16, 17 or 17'. This is clearly shown in FIGS. 1 and 4. Thus, all of the wrenches are pivotally and adjustably attached at their outer ends to one another by means of the turn-buckles 23 and 24 to form a tying circle. The retaining pins 22 have a head 25 and a cotter pin 26 for easy detachment of the turn-buckles from the associated wrench handles 19. The turn-buckles serve to adjust the distance between the outer ends of the wrenches, so as to avoid any play in the circular direction. The pins 22 are free to move radially within the elongated openings 21, but are biased towards the radially inner ends of said openings 21 by means of a leaf spring 27 forming a yoke, the outer ends of which are applied against the ends of the stems of the outer turn-buckles 23, with the center of the leaf spring fixed to the boss 20 by means of a wing bolt 28. The handle 19 of each wrench is provided with a rounded stock pin 29 intermediate the ends of the handle and a wrench support ring 30 engages the pin 29 of all the wrenches radially outwardly of the same. This ring 30 is in the shape of a flat channel and the handle of each wrench is retained flat against said channel by means of a U-clamp 31 having threaded ends on which nuts 32 are screwed. The U-clamps 31 allow limited pivotal movement of the wrench handles with respect to the support ring 30. The support ring 30 maintains the arrangement of all the wrenches in a common plane. This plane is normal to the longitudinal axes of the studs 12. In order to positively maintain the socket carried by collar 18 in engagement with the respective nuts 14, it is preferable to provide a tension spring 33, which is hooked to the wrench handle at one end and to a bracket 34 at the other end for maintaining the spring under tension. In the example shown in FIG. 2, the bracket 34 is in the form of a key, which surrounds a nut 35 screwed on stud 12, the latter protruding from the flange 36 of the pressure vessel body 8.

Figure 4:
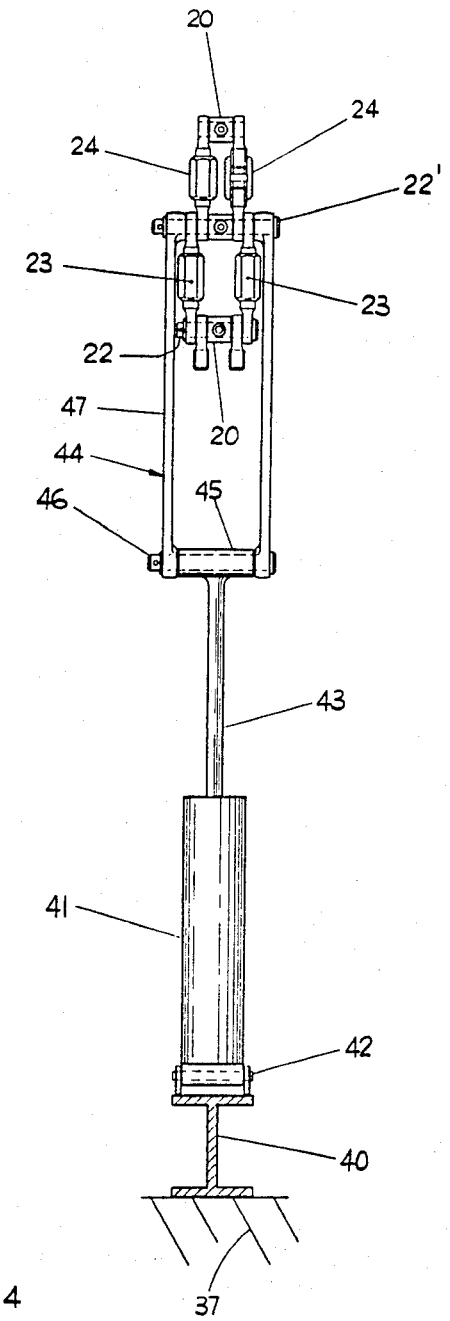
FIG. 4 is an elevation of one of the piston-and cylinder arrangement connected to the ring circle, partially shown.

By applying a rotating force on the tying circle which connects the outer ends of the wrenches 16 in one or the other direction, simultaneous screwing or unscrewing of the nuts 14 is obtained. To achieve this, a hydraulically-powered system is used. A rigid frame 40 is secured in position, for instance on the floor 37 in the general plane of the pressure vessel head 10. The frame 40 is of square shape, and adjacent each corner thereof, there is mounted a cylinder-and-piston arrangement 41 pivoted at 42 to a bracket secured to the inside of frame 40. The piston rod 43 of each cylinder arrangement 41 forms at its outer end a pivoted yoke 44 consisting of the bored transverse leg 45 of piston rod 43 and of two parallel arms 47 pivoted to leg 45 by pin 46 and on the ends of a pin 22', which is longer than the remaining pins 22 but which otherwise have the same function, that is pivotally connect adjacent pairs of turn-buckles 23, 23, as shown in FIG. 4. In the example shown, there are four hydraulic cylinders 41 connected to the tying circle at spaced-apart points thereof and arranged tangentially to that tying circle. The cylinders 41 are hydraulically fed and are double-acting, so that the tying circle may be rotated clockwise or anti-clockwise. The hydraulic lines 48 for cylinders 41 are interconnected in parallel and are connected to a three-way valve 49, in turn fed by a manual hydraulic pump 50 operated by a lever 51. The valve 49 has three positions and is operated by a control line 48; the three positions are: neutral, clockwise and anti-clockwise. The system may be provided with manometers to indicate the fluid pressure and, therefore, this is an indication of the precise torque applied by all the wrenches on the individual nuts. Obviously, the pump for supplying the hydraulic pressure to the various cylinders 41 could be motorized.

The elongated openings 21 receiving the pivot pins 22, 22' at the tying circle allow for the rotation of the individual wrenches each about a center, namely: the axis of the nut 14, which is different from the center of rotation of the tying circle. By proper adjustment of the individual turn-buckles, it will be realized that all the wrenches can be rotated through a preceisely-equal angle and all simultaneously. Using the integral box-ratchet-type socket wrench 16 of FIG. 2, the device will be used with a maximum of efficiency for tightening of the nuts 14, in a few strokes. Wrench 16 is preferred, since the axis of handle 19 intersects nut 14. Two other ratchet-type socket wrenches can be used, as shown in FIGS. 5 and 6. They are less preferred, since their nut-engaging socket 53 or 55, journalled in the inner end of the handle 19, are offset relative to handle 19.

The pawl-and-ratchet system of wrenches 16, 17 or 17' applies torque to the socket in one direction only, thereby allowing free return movement of the handle. A two-way ratchet system can also be provided to allow unscrewing of the nuts by also exerting a reciprocating action on the tying circle.

FIG. 7 schematically shows in full line a bolting circle 54 of a given diameter and along which all the nuts and studs of the pressure vessel head are disposed and showing the cylinder-and-piston arrangement connected to the wrenches 16, 17 or 17' at equally-spaced-apart points around the bolting circle. FIG. 7 shows that in the case of a bolting circle of a larger or smaller diameter, as indicated in dot-and-dash lines, it is necessary to outwardly displace the cylinder-and-piston arrangement, so that they will remain tangential to the tying circle. Also, it is necessary to replace the wrench-support ring 30 by another similar one, but of another appropriate diameter. Should the number of nuts to be screwed or unscrewed be more or less than that shown, the system can be easily modified, so as to decrease or increase the number of individual wrenches.

The assembly of the present invention can also be used for studs arranged in a or several straight lines, such as a square, along a curve other than a circle.

What I claim is:

1. An assembly for manipulating a plurality of screw-type fasteners disposed in a bolting circle, comprising: a plurality of wrenches of a number equal to that of said fasteners, each having a fastener fitting inner end portion and an elongated handle generally outwardly extending from said inner end portion and having an outer end portion, tying means pivotally attaching to one another the outer end portions of said wrench handles to form a tying circle and including an elongated rigid tie member for each pair of wrenches, each tie member including means to adjust its length, a pair of pivot members carried by the two ends of said tie member and pivotally connected to the outer end portions of said pair of wrenches, and means permitting translation movement of said pivot members along the length of the handles of said pair of wrenches, and power-operated means to rotate said tying circle, said power-operated means including a hydraulic cylinder and piston arrangement connected to the tying circle at one end and to a stationary member at its other end.

2. An assembly as defined in claim 1, wherein said means permitting translation movement of said pivot members along the length of the handles, include said handles, each having an elongated opening extending longitudinally thereof, said pivot members having a sliding fit in said openings.

3. An assembly as defined in claim 2, wherein said tie members each consist of a turnbuckle.

4. An assembly as defined in claim 2, wherein each tie member consists of a pair of parallel turnbuckles, the turnbuckles of one pair being interdigitated with the turnbuckles of an adjacent pair.

5. An assembly as defined in claim 1, further including means to support said wrench handles in a common plane while allowing relative pivotal movement of said handles.

6. An assembly as defined in claim 5, wherein said last-named means includes an annular wrench support plate applied flat against the wrench handles and means to retain said wrench handles on said annular plate while allowing limited pivotal movement of said wrench handles with respect to said support plate.

7. An assembly as defined in claim 1, wherein said wrenches are ratchet-type socket wrenches.

8. An assembly as defined in claim 1, wherein said stationary member includes a frame arranged in the general plane of and spacedly surrounding said bolting circle, said hydraulic cylinder and piston arrangement and additional such arrangements pivotally attached at spaced points of said frame and to spaced points of said tying circle, said cylinder and piston arrangements extending along spaced tangential lines of said tying circle for conjointly applying a rotating force on said tying circle.

9. An assembly as claimed in claim 1, further including spring means applying a bias to the individual wrenches in the region of their fastener-engaging end portion and urging the latter in engagement with the respective fasteners.

10. An assembly as claimed in claim 9, wherein said spring means includes a tension coil spring for each wrench, said spring hooked to the wrench handle at one end and to a stationary part at the other end.

11. An assembly as defined in claim 2, further including spring means carried by the outer end of each wrench handle and biasing said pivot pin into the radially inner end of said elongated opening.

* * * * *